US009944498B2

(12) United States Patent
Ford et al.

(10) Patent No.: US 9,944,498 B2
(45) Date of Patent: Apr. 17, 2018

(54) CRANE AND RELATED METHOD OF OPERATION

(71) Applicant: Jaguar Land Rover Limited, Whitley Coventry Warwickshire (GB)

(72) Inventors: Niall Ford, Warrington (GB); Andy Conlon, Widnes (GB); Daniel Thatcher, Woolton (GB)

(73) Assignee: Jaguar Land Rover Limited, Whitley, Coventry, Warwickshire (GB)

( * ) Notice: Subject to any disclaimer, the term of this patent is extended or adjusted under 35 U.S.C. 154(b) by 678 days.

(21) Appl. No.: 14/406,152

(22) PCT Filed: Jun. 7, 2013

(86) PCT No.: PCT/EP2013/061786
§ 371 (c)(1),
(2) Date: Dec. 5, 2014

(87) PCT Pub. No.: WO2013/182675
PCT Pub. Date: Dec. 12, 2013

(65) Prior Publication Data

US 2015/0122761 A1 May 7, 2015

(30) Foreign Application Priority Data

Jun. 7, 2012 (GB) ..... 1210057.4

(51) Int. Cl.
*B66C 13/18* (2006.01)
*B66C 15/04* (2006.01)
(Continued)

(52) U.S. Cl.
CPC ..... *B66C 13/18* (2013.01); *B66C 13/063* (2013.01); *B66C 13/16* (2013.01); *B66C 13/46* (2013.01);
(Continued)

(58) Field of Classification Search
CPC ..... B66C 13/18; B66C 13/063; B66C 13/16; B66C 13/46; B66C 15/04; B66C 15/045; B66C 15/065; B66C 19/00
See application file for complete search history.

(56) References Cited

U.S. PATENT DOCUMENTS 8,276,461 B2 10/2012 Zwygart

FOREIGN PATENT DOCUMENTS

CN 101454235 A 6/2009
EP 0847958 A1 12/1997
(Continued)

OTHER PUBLICATIONS

Chinese Office action corresponding to CN application No. 201380040225.3, dated Sep. 25, 2015, 11 pages.
(Continued)

*Primary Examiner* — Jerrah Edwards
*Assistant Examiner* — Mathew Franklin Gordon
(74) *Attorney, Agent, or Firm* — Reising Ethington P.C.

(57) ABSTRACT

The present invention relates to a crane (101). The crane (101) has a hoist (113), movable in at least one lateral direction (X, Y), for performing a lifting operation. A controller (125) is provided for controlling lateral movement of the hoist (113). An imaging sensor (127) is provided for detecting a person in a defined safety region (145, 147). The controller (125) is configured to inhibit operation of the crane (101) when the imaging sensor (127) detects a person in said safety region (145, 147). The invention also relates to a control system for a crane (101) and a related method.

18 Claims, 10 Drawing Sheets

(51) Int. Cl.

| | |
|---|---|
| ***B66C 13/46*** | (2006.01) |
| ***B66C 19/00*** | (2006.01) |
| ***B66C 13/16*** | (2006.01) |
| ***B66C 13/06*** | (2006.01) |
| ***B66C 15/06*** | (2006.01) |

(52) U.S. Cl.
CPC ..... *B66C 15/04* (2013.01); *B66C 15/045* (2013.01); *B66C 15/065* (2013.01); *B66C 19/00* (2013.01)

(56) References Cited

FOREIGN PATENT DOCUMENTS

| | | | |
|---|---|---|---|
| EP | 1695936 | A1 | 2/2006 |
| EP | 1939131 | A2 | 2/2008 |
| JP | H09175779 | A | 7/1997 |
| JP | 2003146579 | A | 5/2003 |
| JP | 2008265984 | A | 11/2008 |
| JP | 2011006163 | A | 1/2011 |
| KR | 20100120459 | A | 11/2010 |

OTHER PUBLICATIONS

International Search Report for application No. PCT/EP2013/061786, dated Nov. 8, 2013, 8 pages.
UK Combined Search and Examination Report for corresponding application No. GB1310139.9, dated Dec. 5, 2013, 6 pages.

Crane operation truth table

| Manoeuver | Explanation of Control | Height Limit true | Load Cell true | IR (inner) true | Flag (LOUS) true | Flag (LOS) true | CRANE CONTROL (Enable ✓ Disable X) | CREEP (1 second pulse) | LNG TRV REVERSE | LNG TRV FORWARD | LNG TRV SPEED 2 | LNG TRV SPEED 3 | CRS TRV FORWARD (LEFT) | CRS TRV REVERSE (RIGHT) | CRS TRV SPEED 2 | HOIST DOWN | HOIST DOWN SPEED 2 | HOIST DOWN SPEED 3 | HOIST UP | HOIST UP SPEED 2 | HOIST UP SPEED 3 | LIGHT |
|---|---|---|---|---|---|---|---|---|---|---|---|---|---|---|---|---|---|---|---|---|---|---|
| Moving Crane (high up) above position to pick a die. | Allow full speed operation in all directions because load is no danger to personnel | 0 | 0 | 0 | 0 | 0 | ✓ | X | ✓ | ✓ | ✓ | ✓ | ✓ | ✓ | ✓ | ✓ | ✓ | ✓ | ✓ | ✓ | ✓ | ✓ |
| Whilst moving fast high up in a safe area and the chains accidentally snag on something | Whilst moving fast high up in a safe area and the chains accidentally snag on something. Cut all motions immediately to limit damage | 0 | 1 | 0 | 1 | 0 | X | | | | | | | | | | | | | | | |
| Lower hoist, no load, to approach pick up position of Die | Because chains are in a dangerous position the left right, fwd back, needs to be limited to creep speed. This allows jogging with the operator in the dangerous position, but monitoring no load i.e. no load being accidentally dragged. | 1 | 0 | 0 | 0 | 0 | ✓ | ✓ | ✓ | ✓ | X | X | ✓ | ✓ | X | ✓ | ✓ | ✓ | ✓ | ✓ | ✓ | ✓ |
| Lower hoist, no load, to approach pick up position of Die (But personnel in danger zone - similar to when Attaching Hooks to Die) | Because chains are in a dangerous position the left right, fwd back, needs to be limited to creep speed. This allows jogging with the operator in the dangerous position, but monitoring no load i.e. no load being accidentally dragged. | 1 | 0 | 1 | 0 | 0 | ✓ | ✓ | ✓ | ✓ | X | X | ✓ | ✓ | X | ✓ | ✓ | ✓ | ✓ | ✓ | ✓ | ✓ |
| Initial Lift (Taking Weight) | Initial Lifting of Die, danger of load swing possible, therefore stop up movement if personnel in Danger Zone (This is when no one is in the danger Zone) | 1 | 1 | 0 | 1 | 0 | ✓ | ✓ | ✓ | ✓ | X | X | ✓ | ✓ | X | ✓ | ✓ | ✓ | ✓ | ✓ | ✓ | ✓ |
| Initial Lift (Taking Weight) | Initial Lifting of Die, danger of load swing possible, therefore stop up movement if personnel in Danger Zone (This is when there IS someone in the danger Zone) | 1 | 1 | 1 | 1 | 0 | X | | | | | | | | | | | | | | | |
| Initial Lift (With Load Stabilised) | Initial Lifting of Die, after load has stabilised (This is when no one is in the danger Zone) | 1 | 1 | 0 | 0 | 1 | ✓ | ✓ | ✓ | ✓ | X | X | ✓ | ✓ | X | ✓ | ✓ | ✓ | ✓ | ✓ | ✓ | ✓ |
| Initial Lift (With Load Stabilised) or lowering (with Load Stabilised) | Initial Lifting of Die, after load has stabilised (This is when there IS someone in the danger Zone) | 1 | 1 | 1 | 0 | 1 | ✓ | ✓ | ✓ | ✓ | X | X | ✓ | ✓ | X | ✓ | ✓ | ✓ | ✓ | ✓ | ✓ | ✓ |
| Load On, High up with load out of Danger | All ok, no danger, allow all motion at full speed. | 0 | 1 | 0 | 0 | 1 | ✓ | X | ✓ | ✓ | ✓ | ✓ | ✓ | ✓ | ✓ | ✓ | ✓ | ✓ | ✓ | ✓ | ✓ | ✓ |

Height limit true = Dangerous/low | Load cell true = Applied load | IR (inner) true = person in inner danger area | IR (outer) true = person in outer danger area | Flag safe true = See diagram

A

Figure 5

CRANE AND RELATED METHOD OF OPERATION

TECHNICAL FIELD

The present invention relates to a crane, a crane control system and a method of operating a crane.

BACKGROUND OF THE INVENTION

It is well known to use a gantry crane 1 of the type illustrated in FIG. 1 to transport a load in a manufacturing plant. For example, gantry cranes 1 are used to transport machine dies 3 for pressing motor vehicle body panels in a sheet metal pressing facility. The crane 1 is operated by a dedicated crane operator and one or more sling operators.

The crane 1 comprises a bridge 9 movable in a longitudinal direction X. A crab unit 11 housing a hoist 13 is movably mounted on the bridge 9 and can travel in a transverse direction Y. A rectangular lifting frame 15 is supported by the hoist 13 and four slings 17*a-d* are permanently connected to the lifting frame 15. The four slings 17*a-d* each have a coupling provided at their free ends (i.e. at the end distal from the lifting frame 15) to be attached to respective fixing points 19*a-d* on a load such as a press tool or die 3 and secured by a locking pin. Operating the hoist 13 raises and lowers the lifting frame 15, thereby raising and lowering the die 3. The die 3 is transported by moving the bridge 9 and/or the crab unit 11 once the die 3 has been raised.

In view of the loads involved, the transport of the die 3 to and from the die bed is potentially dangerous. When the lifting frame 15 is travelling within the die bed, one of the slings 17*a-d* could snag a stationary object (such as a die 3) causing it to be displaced. When a lifting operation is initially performed by the hoist 13, one of the slings 17*a-d* could snag on the die 3 to be lifted and result in an uncontrolled movement. Furthermore, when the die 3 is initially lifted it may be out of balance resulting in an initial displacement or swinging action before the die 3 centres. When the die 3 is travelling, it could collide with a stationary object or another die 3. These are potentially hazardous scenarios and considerable care is required by the crane and sling operators.

The present invention sets out to help ameliorate or overcome at least some of the problems associated with prior art systems.

SUMMARY OF THE INVENTION

Aspects of the present invention relate to a crane, to a control system for a crane, and to a method of operating a crane.

In a further aspect, the present invention relates to a crane comprising:

- a hoist for performing a lifting operation, the hoist being movable in at least one lateral direction;
- a controller for controlling lateral movement of the hoist; and
- an imaging sensor for detecting a person in a defined safety region;
- wherein the controller is configured to inhibit operation of the crane when the imaging sensor detects a person in said safety region.

Advantageously, when an individual, for example a crane or sling operator, is detected within the safety region, the controller may operate to inhibit operation of the crane. The controller can thereby help to promote safe operation of the crane.

The imaging sensor can comprise a visible light (optical) camera, for example utilising motion detection to detect the presence of a person. Alternatively, or in addition, a thermal imaging camera can be provided. Other techniques could be employed for detecting the presence or absence of a person in the safety region.

When inhibiting operation of the crane, the controller can be configured to inhibit lateral movement of the hoist. To inhibit lateral movement of the hoist, the controller can be configured to reduce a travel speed of the hoist; or to enforce incremental movement of the hoist (a so-called 'creep' or 'inching' mode). Alternatively, the controller can be configured to stop lateral movement of the hoist. The controller could be configured to progressively reduce the travel speed of the hoist, thereby bringing the hoist to a stop over a period of time. The lateral movement of the hoist can comprise left, right, forward and backward movements of the hoist, or any combination thereof.

The controller can be configured to inhibit operation of the crane only when the hoist is performing a lifting operation. In this arrangement, the controller would not inhibit operation of the crane during other operating modes, for example when the hoist is performing a lowering operation. An operator can thereby help to guide a load as it is lowered without the controller inhibiting operation of the crane.

When inhibiting operation of the crane, the controller could be configured to inhibit operation of the hoist. The operating speed of the hoist could be reduced to slow performance of a lifting operation. Alternatively, the controller could be configured to control the hoist to prevent a lifting operation. The hoist can also perform a lowering operation for lowering a load. The controller could be configured to inhibit a lifting operation without affecting a lowering operation performed by the hoist.

The crane can further comprise a load sensor for monitoring an applied load. The controller can be configured to inhibit operation of the crane if the load sensor detects a load equal to or greater than a pre-defined threshold (for example 40 metric tons). The threshold can be defined to protect against over-loading the crane, for example if the hoist lifts a die which is attached to a bolster. The controller can be configured to inhibit operation of the crane if the load sensor detects an increase in the applied load after an initial load application. Any such increase in the load can be indicative of an event, such as a collision.

At least one coupling can be attached to the hoist for connection to a load. The coupling can be a hook or other attachment means. A height sensor can be provided for monitoring an operating height of the coupling. The operating height of the coupling is referred to herein as the hoist travel position. An encoder can be provided on the hoist for measuring the hoist travel position.

The controller can be configured to inhibit a lifting operation when the hoist travel position is outside of a pre-defined operating range; or above a pre-defined operating height. The controller can be configured to inhibit operation of the hoist if the load sensor detects an applied load when the hoist travel position is outside of the pre-defined range or above the pre-defined operating height.

The controller can be configured to inhibit lateral movement of the hoist when the height sensor detects that the coupling is below a pre-defined reference height. The controller can be configured to reduce the travel speed of the hoist. Alternatively, the controller can be configured to permit only incremental lateral movements of the hoist when the height sensor determines that the coupling is below the pre-defined operating height.

When a load is first lifted off of a support, there may be an initial load swing if the hoist is offset from the centre of the load (referred to as being off-centre). The controller can be configured to restrict or inhibit a hoist lifting operation and/or lateral movement of the crane for a defined period of time following the initial lifting of a load. The load sensor can determine when the load is initially lifted and suspended from the crane (referred to herein as an initial load application). Following the initial load application, the controller can be configured to restrict or inhibit operation of the crane. The controller can inhibit operation of the crane for a period of time calibrated to allow the load swing to abate, optionally taking into account the distance from the hoist to the load. For example, the period of time can be 5, 10 or 15 seconds. The load cell may detect variations in the applied load during a load swing event due to the acceleration of the load. Rather than specify a discrete time period to allow the load swing to abate, the controller could inhibit the lifting operation in response to detected variations in the load.

When the crane is carrying a load, operating the hoist to raise or lower the load will result in a variation in the applied load due to vertical acceleration of the load. The controller could apply a filter and/or a threshold to help avoid inhibiting lateral movement of the hoist in response to any such variations in the applied load resulting from acceleration of the load. Alternatively, the controller can check whether a lifting operation is being performed, for example by communicating with the controller to check for user inputs. The controller can be configured to inhibit operation of the crane when the load sensor detects an increase in the applied load when there is no corresponding lifting operation.

During an initial load application, the load cell can detect a loading comprising an initial load increase (and possibly also an overshoot) which then settles to steady state. These load characteristics should only be detected below a reference height when an initial load application is performed by the hoist. The controller can be configured to disregard any overshoot measurement and rely on sampling the load sensor signal at steady state. If the applied load increases from a substantially steady state condition at any other time, this may indicate a potential snag event and the controller is configured to inhibit operation of the crane, for example to inhibit lateral movement of the hoist.

A sudden decrease in the measured load may be representative of an event, such as release of a snagged sling. The controller could be configured to inhibit operation of the crane in response to a reduction in the load measured by the load cell. A check could be performed to determine if the hoist is performing a lowering operation. This functionality could be suspended during a hoist lowering operation.

The load sensor can measure the load applied to the crane. The load sensor could, for example, measure the load applied at the hoist or at a coupling for connecting a load.

A load position sensor can be provided for monitoring the position of the load. The load position sensor can, for example, monitor the position of the load relative to the hoist. The load position sensor can, for example, comprise a laser and an associated receiver. A target can be provided to reflect light emitted from the laser to the receiver. The target could be provided on the load or could be provided on a lifting frame coupled to the hoist. Detecting the reflected signal enables the position of the load to be calculated. The receiver can, for example, comprise a charge-couple device (CCD) for detecting the reflected light from the laser.

One or more additional sensors could be provided to measure any load swing. For example, the crane could comprise more than one load sensor to measure the load applied at one or more slings. Alternatively, a motion detection system could detect load swing.

An override switch can be provided for overriding the controller to disable the inhibited operation of the crane. The override switch can, for example, be used to facilitate crane maintenance and/or calibration. An alert, for example a flashing lamp, can be provided to indicate that the override is active.

In a still further aspect, the present invention relates to a crane comprising:

- a hoist for performing a lifting operation, the hoist being movable in at least one lateral direction; and
- a controller for controlling lateral movement of the hoist;
- wherein the controller is configured to implement an inhibited travel mode in which the hoist travels in incremental lateral movements.

In relation to a reference position, it will be understood that the incremental lateral movements of the hoist can be to the left, to the right, forwards or backwards, as required, or according to any combination of these directions.

The controller can be configured to cause the hoist to travel a predetermined distance in response to each user input when said inhibited travel mode is implemented. Accordingly, each time a joystick and/or trigger is actuated on the control unit, the crane travels a predetermined distance. The controller does not permit any further travel of the hoist for that particular actuation of the joystick and/or trigger (regardless of how long the joystick and/or trigger are held in an actuated position). Rather, the joystick and/or trigger must be returned to a neutral position and actuated again to cause the controller to initiate another incremental lateral movement of the hoist. The controller thereby enables incremental lateral travel of the hoist in response to each discrete actuation of the remote control.

The crane can further comprise a load position sensor for determining the position of the load relative to the hoist. The load position sensor can comprise a laser transceiver.

In a further aspect, the present invention relates to a method of operating a crane comprising a hoist for performing a lifting operation, the hoist being movable in at least one lateral direction;

- the method comprising engaging an inhibited travel mode to restrict hoist travel to an incremental lateral movement. Such restriction can require a user to enter a user input for each incremental lateral movement, i.e. an Incremental lateral movement can be produced in response to each user input.

In a still further aspect, the present invention relates to a crane comprising:

- a hoist for performing a lifting operation, the hoist being movable in at least one lateral direction;
- a controller for controlling lateral movement of the hoist; and
- a coupling attached to the hoist for connection to a load; and
- a height sensor for monitoring a height of the coupling;
- wherein the hoist controller is configured to inhibit lateral movement of the hoist when the height sensor detects that the coupling is below a pre-defined operating height or that the coupling is outside one or more pre-defined operating height ranges. The operating height can be a reference height.

The controller can be configured to reduce the travel speed of the hoist or to permit only incremental lateral movements of the hoist when the height sensor determines that the coupling is below the pre-defined operating height. The height of the coupling can be measured directly or indirectly, for example with reference to the height of a lifting frame.

In a still further aspect, the present invention relates to a method of operating a crane comprising a hoist and a coupling attached to the hoist;

wherein the method comprises monitoring a height of the coupling; and inhibiting lateral movement of the hoist when the height sensor detects that the coupling is below a pre-defined operating height or that the coupling is outside one or more pre-defined operating height ranges.

In a yet further aspect, the present invention relates to a crane comprising:

a hoist for performing a lifting operation, the hoist being movable in at least one lateral direction;

a controller for controlling lateral movement of the hoist; and a load sensor for monitoring an applied load;

wherein the controller is configured to inhibit operation of the crane if the load sensor detects an increase in the applied load while the hoist is undergoing lateral movement.

In a further aspect, the present invention relates to a method of operating a crane comprising a hoist movable in at least one lateral direction;

wherein the method comprises monitoring an applied load; and inhibiting operation of the crane if the applied load increases whilst the hoist is undergoing lateral movement. The lateral movement of the hoist can be inhibited when the load sensor detects an increase in the applied load when there is no corresponding lifting operation.

In a yet further aspect, the present invention relates to a method of operating a crane comprising a hoist;

wherein the method comprises inhibiting a hoist lifting operation for a defined period of time following application of an initial load.

The present invention also relates to a crane control system configured to implement one or more of the methods described herein. The crane control system can be machine-implemented.

According to a further aspect of the invention there is provided a crane comprising:

a hoist for performing a lifting operation, the hoist being movable in at least one lateral direction;

a controller for controlling the hoist; and a height sensor for monitoring a lifting height of the hoist;

wherein the controller is configured to operate the hoist according to first and a second operation modes depending on the lifting height of the hoist.

The controller can be configured to operate the hoist according to the first operation mode in a first lifting height range, and the second operation mode in a second lifting height range. The first and second lifting height ranges can be defined with reference to a pre-defined operating height. The first lifting height range can be above the pre-defined operating height and the second lifting height range can be below the pre-defined operating height, or vice versa. The lifting height can refer to the height of the coupling or load.

According to a further aspect of the invention there is provided a method of operating a crane comprising a hoist and a height sensor for monitoring a lifting height of the hoist, wherein the method comprises automatically operating the hoist according to first and a second operation modes depending on the lifting height of the hoist.

In a further aspect the present invention relates to a computer system comprising: programmable circuitry; and software encoded on at least one computer-readable medium to program the programmable circuitry to implement one or more of the methods described herein.

According to a still further aspect the present invention relates to one or more computer-readable media having computer-readable instructions thereon which, when executed by a computer, cause the computer to perform all the steps of the method(s) described herein.

Within the scope of this application it is expressly intended that the various aspects, embodiments, examples and alternatives set out in the preceding paragraphs, in the claims and/or in the following description and drawings, and in particular the individual features thereof, may be taken independently or in any combination. For example, features described with reference to one embodiment are applicable to all embodiments, unless such features are incompatible.

BRIEF DESCRIPTION OF THE DRAWINGS

An embodiment of the present invention will now be described, by way of example only, with reference to the accompanying figures, in which:

FIG. 5 shows a truth table representing the crane operating modes for performing certain manoeuvres;

DETAILED DESCRIPTION OF AN EMBODIMENT

The present invention relates to a control system for operating a crane in a manufacturing plant. The invention will be described with reference to an electrical overhead travelling (EOT) crane 101 for transporting loads such as machine dies 103 in a sheet metal pressing facility, for example in a car manufacturing plant. By way of example, the dies 103 can each weigh 3-4 metric tons. The crane 101 is controlled by a crane operator and one or more sling operators.

Figure 1:
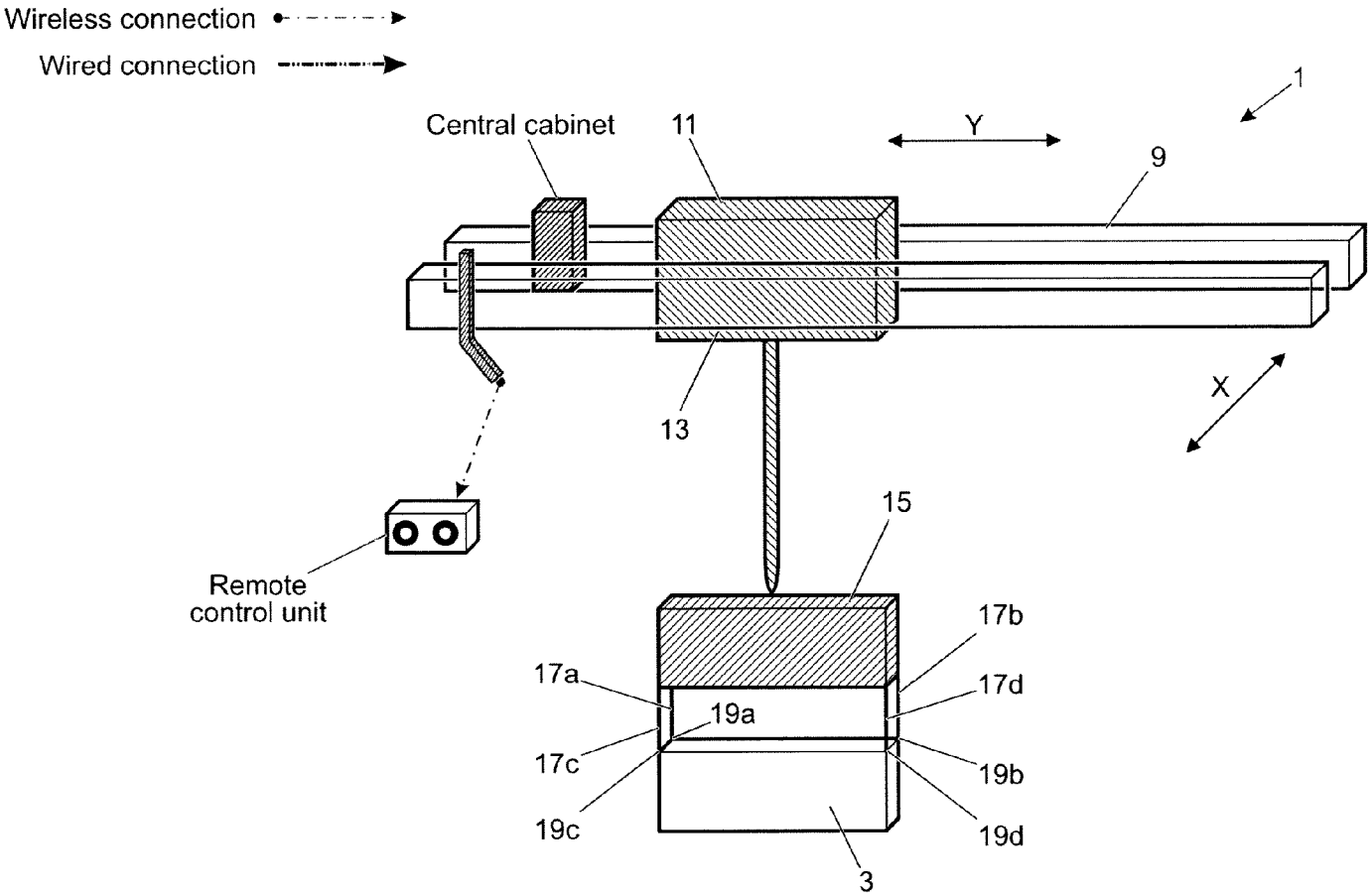
FIG. 1 shows schematically a conventional gantry crane representative of the prior art.
Figure 2:
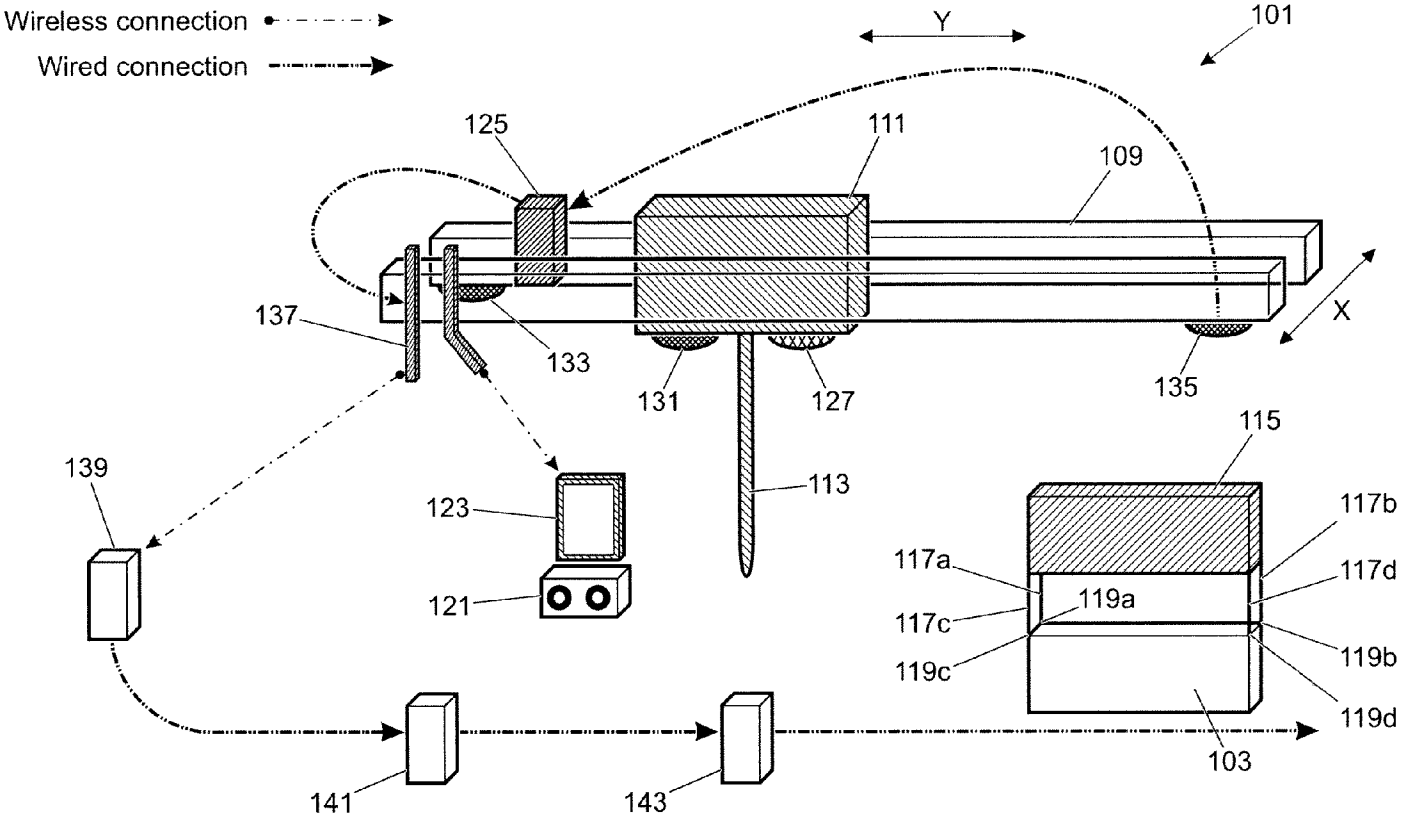
FIG. 2 shows schematically a gantry crane incorporating a control system in accordance with an embodiment of the present invention.

As shown in FIG. 2, the crane 101 comprises a bridge 109 movable in a longitudinal direction X (North/South). A crab unit 111 housing a hoist 113 is movably mounted on the bridge 109 and can travel in a transverse direction Y (East/West). The bridge 109 has three operating speeds and the crab unit 111 has two operating speeds. The hoist 113 has three operating speeds for performing lifting and lowering.

A rectangular lifting frame 115 is supported by the hoist 113 and four slings 117*a-d* are permanently connected to corners of the lifting frame 115. The slings 117*a-d* each have a hook (not shown) fixedly attached at their distal end for attachment to respective fixing points 119*a-d* on the die 103. Operating the hoist 113 raises and lowers the lifting frame 115, thereby raising and lowering the die 103. The die 103 is transported by moving the bridge 109 and/or the crab unit 111 once the die 103 has been raised.

The crane operator controls the crane 101 using a wireless remote control unit 121 incorporating a visual display unit 123. The remote control Unit 121 communicates wirelessly with a central control unit 125 mounted on the bridge 109.

Figure 3:
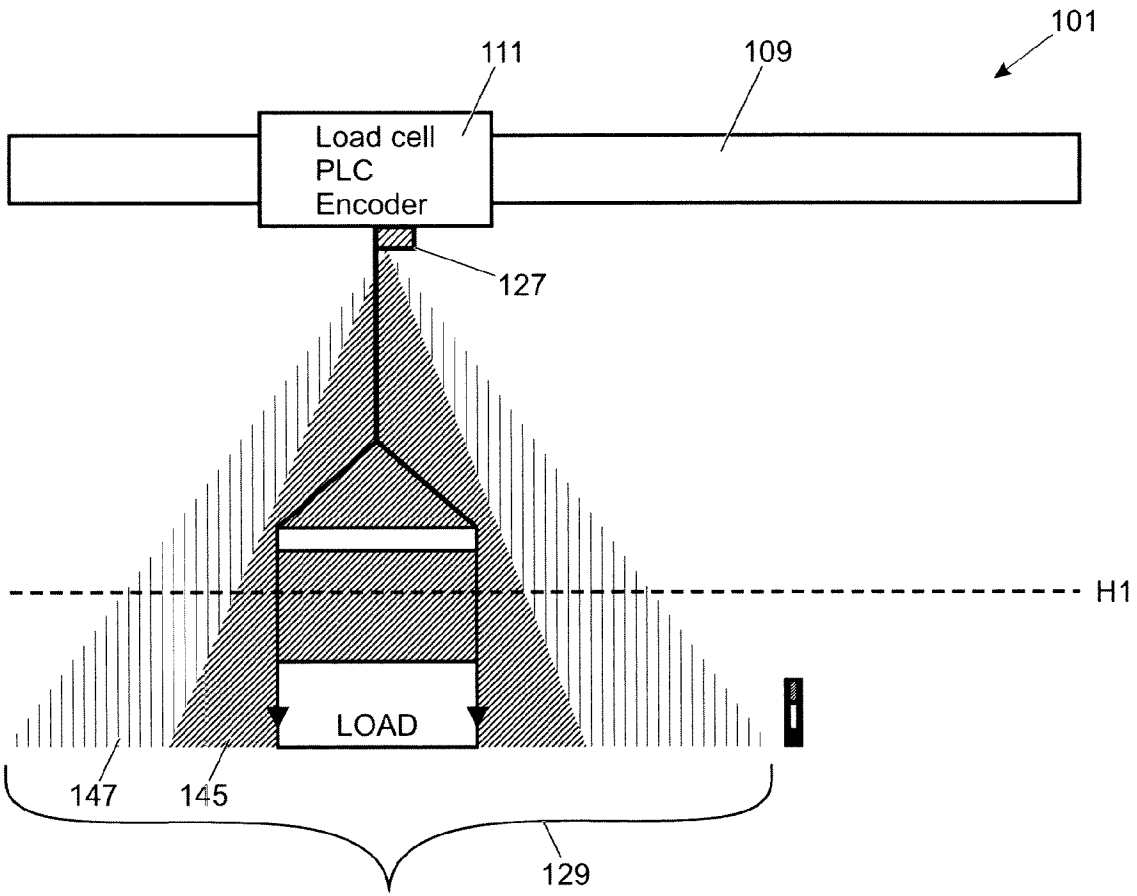
FIG. 3 shows schematically a side view of the operating range of a thermal imaging camera employed in an embodiment of the present invention.

An infra-red thermal imaging camera 127 is provided on the crab unit 111 to monitor an operating zone 129 shown in FIG. 3 encompassing the die 103. A first visual camera 131 is also provided on the crab unit 111 to generate a video stream showing the operating zone 129 in plan view. Second and third video cameras 133, 135 are mounted on opposite ends of the bridge 109 to provide alternate views of the operating zone 129. The video cameras 131, 133, 135 output video data to the central control unit 125.

The central control unit 125 is connected to a wireless transmitter and antenna 137 for wireless transmission of the video data. The transmitted video data is received by the remote control unit 121 to display the video data from the first video camera 131 on the visual display unit 123. The remote control unit 121 could optionally be configured to allow the crane operator to select the video data output from each of the visual cameras 131, 133, 135 for display on the visual display unit 123. A remote wireless receiver 139 also receives the transmitted video data and this data is stored on a storage device 141 coupled to a site network 143. The video data can be stored for a rolling period of, for example, 30 days to provide a reference library.

The operating zone 129 comprises an inner safety region 145 and an outer safety region 147 arranged concentrically. As described herein, the central control unit 125 modifies the control of the crane 101 depending on whether or not an operator (or other person) is present in the inner and outer safety regions 145, 147. The video data from one or more of the visual cameras 131, 133, 135 could be used to detect the presence or absence of an operator, but the movement of ancillary objects can result in high background noise levels. Accordingly, the present embodiment utilises the thermal imaging camera 127 to detect the presence or absence of an operator.

Figure 4:
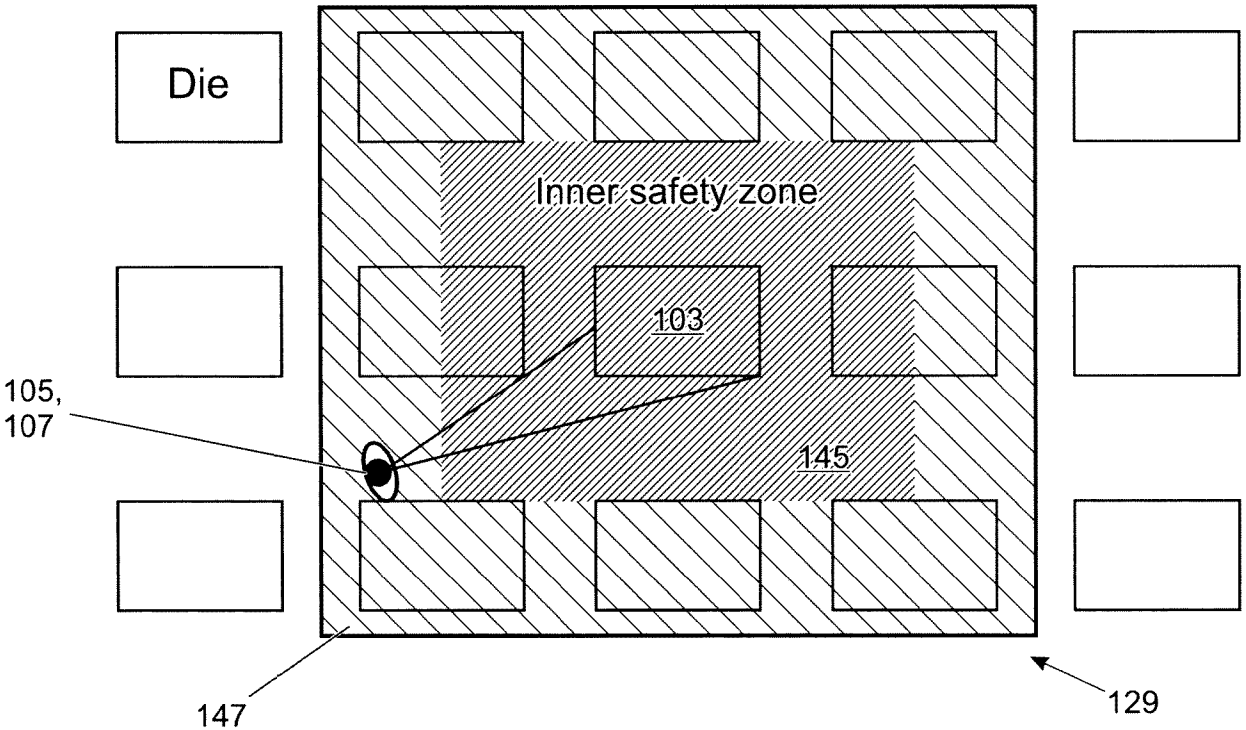
FIG. 4 shows schematically a plan view of the operating range of the thermal imaging camera illustrated in FIG. 3.

As shown in FIGS. 3 and 4, the thermal imaging camera 127 is directed vertically downwards and generates a thermal image of the area surrounding the die 3. The inner safety region 145 is defined as the region surrounding the die 103, typically one die width beyond an outer edge of the die 103. The outer safety region 147 corresponds to a further one die width beyond the inner safety region 145. It will be appreciated that the size of the inner and outer safety regions 145, 147 could be varied for different applications. The perimeter of the die 103 could be pre-defined or could be determined dynamically, for example using the video data from the first visual camera 131.

Figure 7:
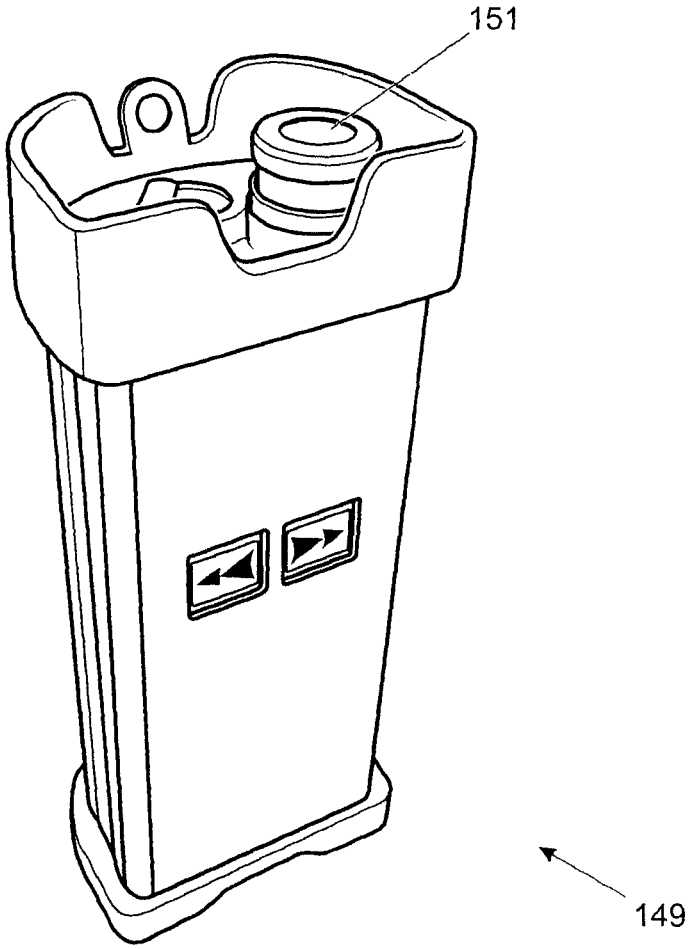
FIG. 7 shows a sling operator safety pendant according to an embodiment of a further aspect of the present invention.

In the event that an operator is detected in the outer safety region 147, the crane operator is notified, for example by illuminating a light. An example of such a light is shown in FIG. 7. If the operator enters the inner safety region 145, the central control unit 125 can disable or inhibit lateral movements of the bridge 109 and the crab unit 111. A lowering operation of the hoist 113 is enabled, but the lifting operation is disabled. Disabling the lifting operation ensures that the hoist 113 does not raise the load and thereby reduces load swing when an individual is proximal the die 103.

The central control unit 125 can operate in response to the output of the thermal imaging camera 127 in isolation, or in combination with a rotary encoder and/or a load cell, as described herein. For example, when the thermal imaging camera 127 detects an operator within the inner safety region 145, the central control unit 125 can be configured to disable or inhibit lateral movements of the crane 101 and/or operation of the hoist 113 only when a load is detected by the load cell. This arrangement enables operators to work within the inner safety region 145 to guide the lifting frame 115 into position for attaching the die 103. The operation of the crane 101 is disabled or inhibited only when a load is initially applied to the crane 101 and an operator is detected within the inner safety region 145. A truth table A representing the operating modes of the crane 101 in response to detected parameters is shown in FIG. 5. The safety control system implemented in the crane according to the present invention will now be described.

Reference Height (H1)

A rotary encoder (not shown) is provided in the hoist 113 to monitor the hoist travel position based on the height of the hooks provided on the slings 117*a-d*. A reference height H1 (shown in FIG. 3) is defined for controlling operation of the crane 101. In the present embodiment, the reference height H1 is set as the height of two stacked dies 103 plus one (1) meter to provide clearance above the stacked dies 103. It will be appreciated that the reference height H1 can be calibrated for a particular die bed or row of die beds in which the crane 101 is operating. The reference height H1 can be set for a particular crane 101, for example dependent on the die bed covered by the crane 101. The reference height H1 for a crane 101 covering a die bed containing multiple stacked dies 103 (for example double or triple stacked dies 103) is likely to be greater than the reference height H1 for a crane 101 covering a die bed with single stacked dies 101.

If the hooks are above the reference height H1, the crane 101 operates in a conventional manner with no restrictions on lateral travel of the bridge 109 or the crab unit 111. However, if the rotary encoder determines that the hooks are below the reference height H1, the translational movement of the bridge 109 and the crab unit 111 are both inhibited. Specifically, the central control unit 125 engages a restricted or inhibited travel mode (also referred to as a 'creep' mode) in which the bridge 109 and the crab unit 111 move a pre-set incremental distance in response to each discrete input made at the remote control unit 121 by the crane operator. Thus, the bridge 109 and the crab unit 111 advance a pre-set distance each time the controls on the remote control unit 121 are operated, for example the bridge 109 and/or the crab unit 111 travel for a one (1) second pulse. The raising and lowering operations of the hoist 113 remain unaffected when the inhibited travel mode is engaged. Rather than implement incremental travel, the central control unit 125 could reduce the travel speed of the bridge 109 and/or the crab unit 111 when the inhibited travel mode is engaged.

The engagement of the inhibited travel mode mitigates load swing and reduces lateral movements of the lifting frame 115 when the hooks are below the reference height H1. The crane operator is encouraged to position the lifting frame 115 directly above the die 103 at a height greater than the reference height H1. The lifting frame 115 can then be lowered by the hoist 113 below the reference height H1 and small lateral movements made accurately to position the lifting frame 115 and the hooks in relation to the die 103. The crane operator can then raise the lifting frame 115 and the die 103 vertically upwardly above the reference height H1 before undertaking any lateral movements. The likelihood of one of the hooks inadvertently snagging a die 103 is reduced as they are maintained above the reference height H1 during lateral travel.

Moreover, the likelihood of the die 103 colliding with a stationary object during travel is reduced as lateral travel is inhibited until the hooks are above the reference height H1. As the reference height H1 includes an additional clearance of 1 m above the height of two stacked dies 103, the supported die 103 will be above the other dies 103 in the die bed.

Load Cell

A load cell (not shown) is provided for measuring the load applied at the hoist 113 and outputting a load data signal to the central control unit 125. An increase in the detected load at the hoist 113 typically corresponds to an initial load application when a load is initially lifted and suspended from the crane 101. During an initial load application, the load cell can detect an increased load comprising an initial overshoot which then settles to a steady state. The central control unit 125 is configured to disregard any overshoot measurement and rely on sampling the load sensor signal at steady state. If the detected load increases from a substantially steady state condition after the initial load application, the central control unit 125 determines that a snag event has occurred and inhibits operation of the crane 101.

The central control unit 125 is configured to check the operational state of the crane 101 to determine whether a detected load is appropriate. The central control unit 125 can apply a filter or perform a comparison with a stored threshold to reduce the likelihood of incorrectly determining that a new load has been applied. In the present embodiment, a threshold load of 500 kg is used to determine whether a new load has been applied. If the central control unit 125 determines that an inappropriate load has been applied, safety protocols are initiated. Typical scenarios requiring the application of a safety protocol are outlined below by way of example.

An increase in the load applied when the lifting frame 115 is travelling in a lateral direction without a corresponding lifting operation, could be an indication that a hook has snagged a stationary die 3. This is dangerous as the force applied could displace the die 3. Accordingly, if the lifting frame 115 is undergoing lateral movement when an increase is detected in the load applied at the hoist 113, the central control unit 125 will stop movement of the crane 101. This is of particular importance if the hoist is travelling, for example above the reference height H1. The central control unit 125 could be configured to stop movement of the crane 101 only if the hooks are above the reference height H1 when the increased load is detected.

When the die 103 is first lifted there is a risk of load swing due to the lifting frame 115 being off-centre with the die 103. As a precaution, the sling operators should be clear of the die 103 when this initial lift occurs. The central control unit 125 classifies the initial lift scenario as load-on unsafe (LOUS) and a check is performed by the thermal imaging camera 127 to determine if any sling operators are within the inner safety region 145. If a sling operator is inside the inner safety region 145 when the load cell detects an increase in the applied load above the defined threshold, the central control unit 125 inhibits the lift operation of the hoist 113. An initial lift of the die 103 cannot be performed while a sling operator is detected by the thermal imaging camera 127 within the inner safety region 145. Only when the inner safety region 145 is free of personnel can the hoist 113 perform an initial lift operation.

The load swing will cease once the centre of gravity of the die 103 is directly beneath the lifting frame 115, at which point the die 103 can safely be lifted. The load swing is considered as having ceased five (5) seconds after an initial lift has occurred. The period of oscillation is dependent on the distance between the winch 113 and the centre of gravity of the load. Therefore it will be appreciated that the time may vary dependent on the height of the bridge 109 above the die 103. Accordingly, the central control unit 125 classes the die 103 as load-on safe (LOS) after a predefined time period of five (5) seconds has elapsed following detection of an increase in the applied load by the load cell. Following the initial lift, if the thermal imaging camera 127 determines that a sling operator has entered the inner safety region 145, operation of the hoist 113 is permitted after this time period has elapsed.

Figure 6:
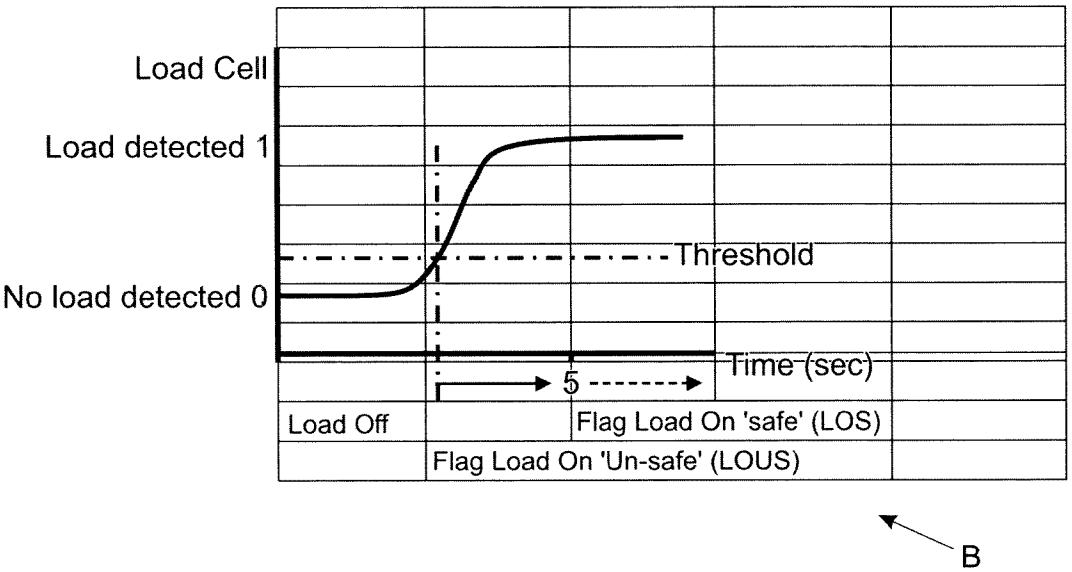
FIG. 6 shows a chart representing the safety classification of the load with reference to a measured load.

The classification of the load as LOUS or LOS with reference to the applied load detected by the load cell is illustrated with reference to a chart B in FIG. 6. The chart B is prepared on the basis that the hooks connected to the slings 17*a-d* are below the reference height H1.

The load cell can also be used to limit the maximum load applied to the crane 101. If the load cell detects a load greater than a defined threshold, for example 40 metric tons, the central control unit 125 can inhibit operation of the hoist 113 and optionally release some of the load. In the event that the crane 101 is operated to lift a die 103 which is bolted to a machine bolster, the central control unit 125 can stop the hoist 113 to prevent damage to the die 103 or the crane 101.

Pendant Control

As outlined above, the crane operator is provided with a remote control unit 121 for controlling operation of the crane 101. The remote control unit 121 is provided with a spring-biased activation switch (not shown) which must be actuated in order to operate the crane 101. The remote control unit 121 is also provided with a controller stop button (not shown) to stop operation of the crane 101.

A further aspect of the present invention relates to a machine control unit (MCU) pendant 149 for each sling operator, as illustrated in FIG. 7. A pendant stop button 151 is provided on the pendant 149 and this must be actuated each time the sling operator enters an area of potential danger, such as the inner safety region 145. The crane 101 is disabled when the pendant stop button 151 is actuated. The remote control unit 121 and said one or more pendants 149 are connected in series. The crane 101 can be operated only when an authorisation signal is received from the remote control unit 121 and each pendant 149. Actuation of the controller stop button or a pendant stop button 151 (on any one of the active pendants 149) will stop operation of the crane 101. The central control unit 125 requires that each of the active pendants 149 be reset and that an affirmation signal is subsequently received from the remote control unit 121 in order to reset the crane 101.

The cameras 131, 133, 135 mounted on the bridge will continue to operate even after actuation of the controller stop button 151, so as to obtain a record of the entire process.

Gantry Display System

Figure 8:
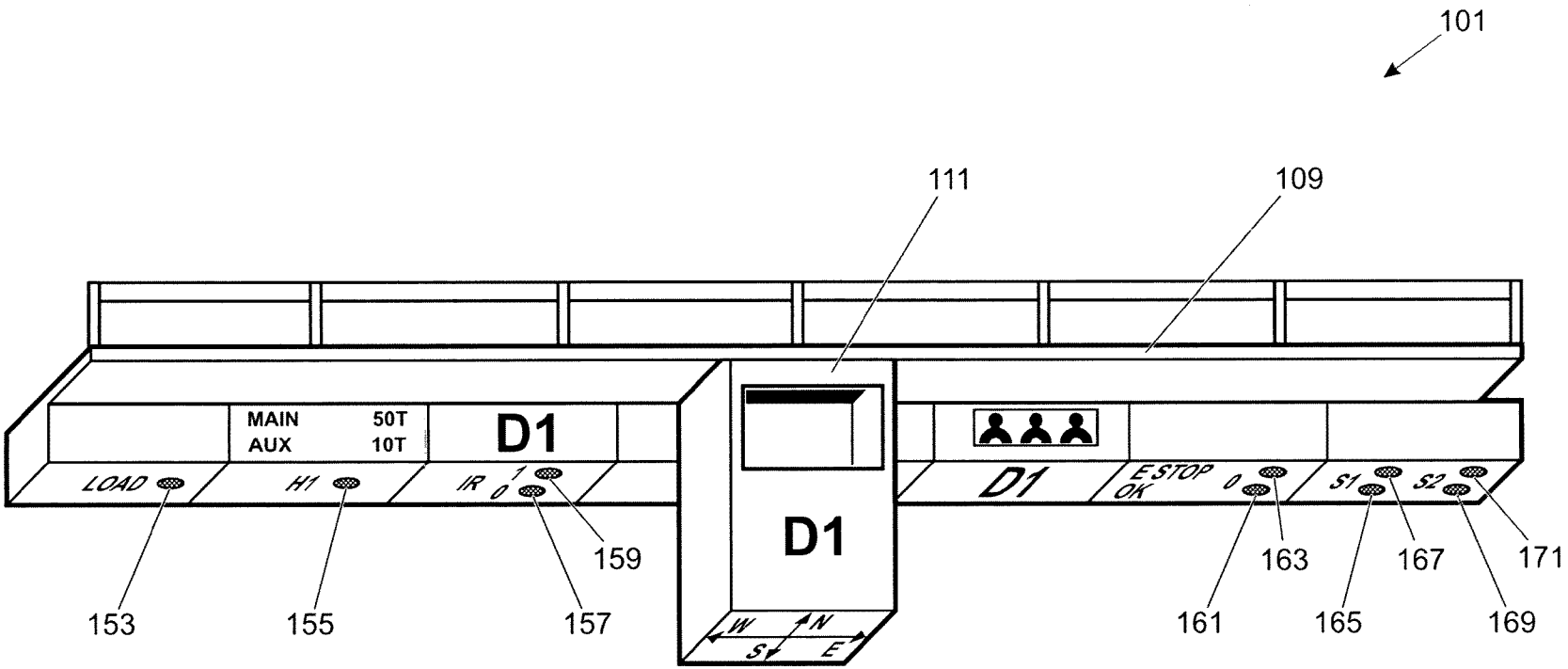
FIG. 8 shows a lighting system for displaying safety information on the crane according to an embodiment of the present invention.

As shown in FIG. 8, a lamp display panel is provided on the bridge 109 to indicate the operational status of the crane 101. By providing the lamps on the bridge 109, they are visible to the crane operator when the crane 101 is in use. Duplicate signals could optionally also be displayed on the remote control unit 121.

A first lamp 153 indicates whether a load is being carried by the crane 101. The first lamp 153 is illuminated when the load cell detects the application of a load at the hoist 113. A second lamp 155 indicates whether the hooks connected to the slings 117*a-d* are above the reference height H1. The second lamp 155 is illuminated when the rotary encoder determines that the hooks are below the reference height H1.

The presence or absence of a person, such as a sling operator, within the inner safety region 145 is indicated by third and fourth lamps 157, 159. The third lamp 157 is green and is illuminated when the thermal imaging camera 127 does not detect anyone within the inner safety region 145. The fourth lamp 159 is red and is illuminated when the thermal imaging camera 127 detects the presence of someone within the inner safety region 145.

The status of the controller stop button is displayed by fifth and sixth lamps 161, 163. The fifth lamp 161 is green and is illuminated when the remote control unit 121 is operational. The sixth lamp 163 is red and is illuminated when the controller stop button is actuated.

The status of first and second pendants 149 is displayed by corresponding pairs of lamps. Specifically, seventh and eighth lamps 165, 167 indicate the status of a first pendant 149. The seventh lamp 165 is green and is illuminated when the first pendant 149 is operational. The eighth lamp 167 is red and is illuminated when the pendant stop button 151 is actuated. The status of the second pendant 149 is indicated by corresponding ninth and tenth lamps 169, 171.

The lamp display panel can comprise additional lamps to indicate when the thermal imaging camera 127 has detected the presence of a person in the inner safety region 145 and/or the outer safety region 147.

The crane operator and the sling operators can readily determine the status of the crane 101 by referencing the lamp display panel on the bridge 109.

Operation

The procedural steps for attaching and transporting the die 103 will be described with reference to FIGS. 9A-D (with a reference key shown in FIG. 9E). The die 103 is supported on a rack in a die bed. To conserve space within the die bed, two or more dies 103 can be stacked on top of each other. The attachment of the die 103 to the crane 101 can be performed by a two (2) or three (3) person team. The procedure will be described for a three (3) person team made up of a dedicated crane operator 105 and two sling operators 107.

Figure 9A:
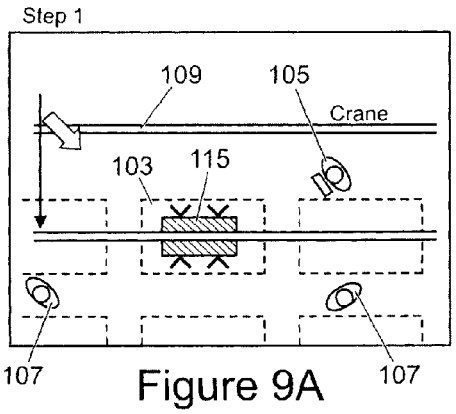
FIGS. 9A-E illustrate the steps for operating the crane to attach and transport a machine die according to an embodiment of the present invention.

As illustrated in FIG. 9A, the crane 101 is initially displaced from the die 103. The hoist 113 is operated to raise the lifting frame 115 so as to clear any obstacles and prevent the slings 17*a-d* fouling. The lifting frame 115 is preferably raised sufficiently that the hooks provided on the slings 117*a-d* are above the reference height H1 to ensure that they do not snag any dies in the die bed as the lifting frame 115 travels to the die 103 to be transported. The crane operator 105 can determine when the hooks are above the reference height H1 by checking whether the second lamp 155 on the bridge 109 is illuminated. When the hooks are above the reference height H1, the central control unit 125 allows the crane 101 to travel in lateral directions at a normal operating speed.

The crane operator 105 positions the crane 101 over the die 103 such that a centre line of the fixing frame 115 is approximately in line with a centre of gravity of the die 103. The crane operator 105 is responsible for positioning the crane 101 while the sling operators 107 observe the crane movements and assist the crane operator 105.

Figure 9B:
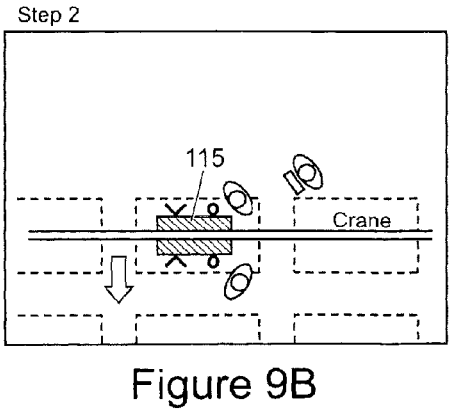

As illustrated in FIG. 9B, the hoist 113 is then operated to lower the lifting frame 115 to enable the hooks to be attached to the fixing points 119*a-d* on the die 103. The lateral movements of the lifting frame 115 are at the normal operating speed until the hooks are below the reference height H1. When the encoder determines that the hooks have been lowered below the reference height H1, the central control unit 125 engages the inhibited travel mode to inhibit lateral movements of the crab unit 111; the operating speed of the hoist 113 is unchanged as the lifting frame 115 is lowered. The sling operators 107 guide the slings into position and, when signalled by the crane operator 105, attach two of the slings 117*b*, 117*d* to opposing fixing points 119*b*, 119*d* on the die 103. If the slings 117*a-d* do not reach the respective fixing points 119*b*, 119*d*, the crane operator 105 may need to reposition the lifting frame 115. The re-positioning of the lifting frame 115 can only be performed in incremental steps as the inhibited travel mode is engaged. It is not necessary for the sling operators 107 to retreat to a safe position whilst the lifting frame 115 is re-positioned since the die 103 is not attached to the lifting frame 115 and the crane 101 is not performing an initial lift operation. As there is no load applied to the hoist 113 (as detected by the load sensor), the central control unit 125 does not disable the hoist 113 even if the thermal imaging camera 127 determines that a sling 107 operator is within the inner safety region 145.

Figure 9C:
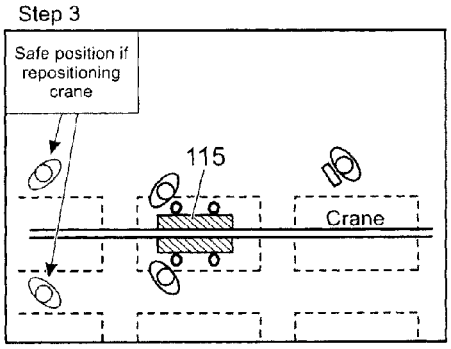
Figure 9D:
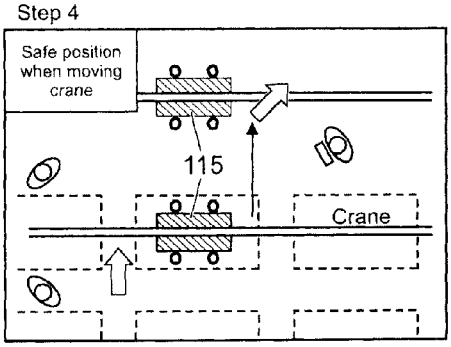
Figure 9E:
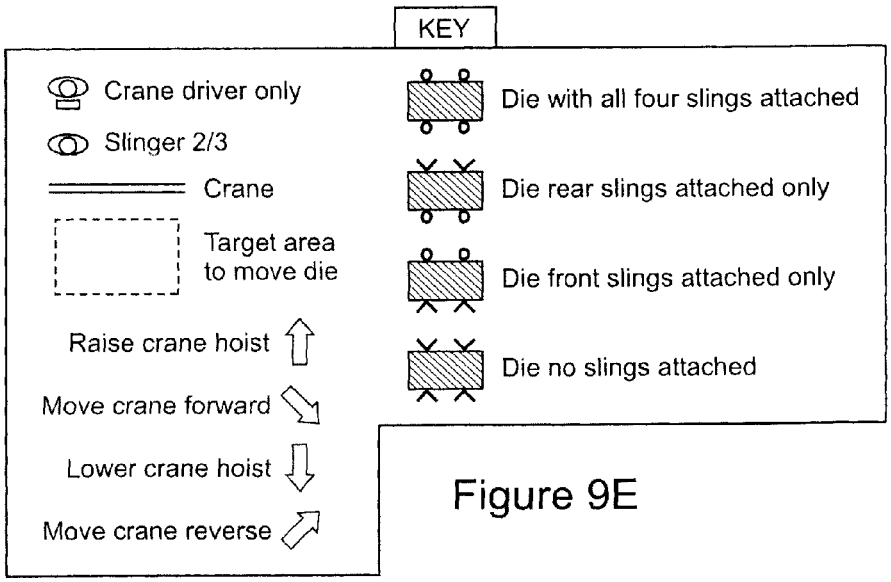

The sling operators 107 then complete the process of connecting the die 103 by attaching the remaining two stings 117*a*, 117*c* to the respective opposing fixing points 119*a*. 119*c*, as illustrated in FIG. 9C.

As illustrated in FIG. 90, the die 103 is thereby connected to the hoist 113. However, before starting to lift the die 103 the crane operator 105 must check that the hoist 113 is over-centre in relation to the die 103. If the hoist 113 is not centred, a load swing will occur when the die 103 is lifted off of the support rack. The sling operators 107 move to a safe position outside of the inner safety region 145 and signal when the crane operator 105 is clear to take the pinch weight. The load cell detects when a load is applied to the hoist 113 and, if the thermal imaging camera 127 detects a sling operator 107 (or other personnel) within the inner safety region 145, operation of the bridge 109, the crab unit 111 and the hoist 113 are disabled. Only when the inner safety region 145 is clear of all personnel can the crane 101 be operated to perform the initial lift of the die 103 (as determined by the load cell). The die 103 is lifted clear of the support rack and held in station until any load swing abates. As a precautionary measure, the central control unit 125 holds the crab unit 111 stationary for a period of time, for example five (5) seconds, following the initial lift. The load swing can abate during this standing time and, as the load is considered to be safe, the sling operator 107 can enter the inner safety region 145. The central control unit 125 does not disable the hoist 113 even if the thermal imaging camera 127 determines that a sling 107 operator is within the inner safety region 145 after this time period. The sling operator 107 can then signal the crane operator 105 that the lift can continue. The crane operator 105 actuates the hoist 113 to raise the die 103 above the reference height H1.

Whilst the die 103 is below the reference height H1, the inhibited travel mode is engaged and lateral travel is inhibited. The central control unit 125 disengages the inhibited travel mode once the die 103 is above the reference height H1 and the crab unit 111 can travel at the normal operating speed. The crane operator 105 then controls the bridge 109 and the crab unit 111 to transport the die 103.

If the load cell detects an increase in the load applied at the hoist 113 whilst the die 103 is travelling in a lateral direction, this may indicate that a collision has occurred. Accordingly, the bridge 109 and the crab unit 111 are brought to a halt if the load cell detects an increase in the applied load during lateral travel.

The procedure for detaching the die 103 from the crane 101 is the reverse of the steps performed to attach the die 103. However, when the die 103 is being lowered, it may be necessary for one or more sling operators 107 to guide the die 103 into position, for example to locate the die 103 on a bolster. Accordingly, during a lowering operation, operation of the hoist 113 is enabled and incremental lateral travel is permitted even if the thermal imaging camera 127 detects the presence of a person within the inner safety region 145. The central control unit 125 can determine when a lowering operation is being performed with reference to one or more of: the load cell, the rotary encoder and the control pendant.

The central control unit 125 is provided with an override switch to override restrictions applied to the crane 101. The override switch can, for example, override the inhibited travel mode when the crane is operating below the reference height H1. The override switch can comprise a mechanical or electronic lock. The override switch can be operated in the event of a component failure or to facilitate specific crane servicing or calibration operations. It is envisaged that the lamps 153, 155, 157, 159, 161, 163, 165, 167, 169, 191 in the lamp display unit would flash when the override is in operation to notify the crane operator 105 and the sling operators 107.

The crane 101 described herein can be modified to provide a load position sensor for determining the relative position of a die 103. The load position sensor can comprise a laser transmitter (not shown) provided on the hoist 113 for directing a beam of light onto a reflector (not shown) mounted on the lifting frame 115. A receiver, such as a charge-coupled device, is provided on the hoist 113 for detecting the reflected signal and measuring the position of the lifting frame 115 relative to the hoist 113.

The ability to determine the position of the die 103 is particularly useful for performing an initial lift. If the lifting frame 115 is displaced from the hoist 113 by a distance greater than a defined threshold, the lifting operation of the hoist 113 can be inhibited. The receiver could be configured to provide feedback to the crane operator 105 to indicate the relative position of the lifting frame 115. The central control unit 125 could be configured automatically to centre the hoist 113 above the lifting frame 115 based on a signal from the load position sensor.

Although the present invention has been described with reference to transporting a machine die, it will be appreciated that the crane can be used to transport other loads. Moreover, the present invention has been described with reference to a gantry crane, but the techniques could be used in other types of crane.

Figure 10:
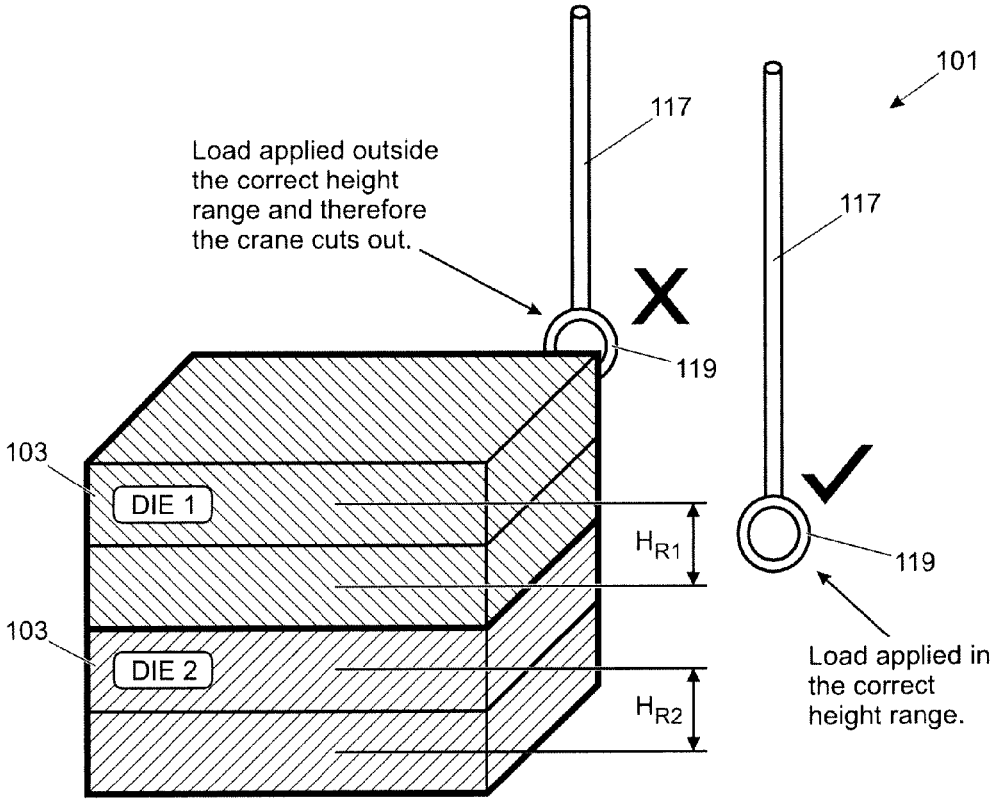
FIG. 10 illustrates controlling operation of the crane based on predefined operating height ranges.

The crane 101 could be further modified to inhibit a hoist lifting operation when the lifting frame 115 and/or the couplings 119*a-d* are outside a pre-defined operating height range $H_R$. The encoder can measure the height of the lifting frame 115 and/or the couplings 119*a-d*. The central control unit 125 can prevent operation of the hoist to perform an initial lifting operation when the measured height is outside of a pre-defined operating height range $H_R$. The operating height(s) can be defined with reference to the height of the fixings provided on the die(s) 103 in a particular die bed. For example, as shown in FIG. 10, in a die bed in which the dies 103 are stacked on top of each other, different operating height ranges $H_{R1}$, $H_{R2}$ can be specified corresponding to the height of the fixings for each die 103 in the stack.

A protective sleeve can be arranged around the coupling. The protective sleeve can be made of rubber, or other resilient material. The protective sleeve can comprise an opening and the coupling can be disposed within said opening. The opening can be substantially larger than a width of the coupling, such that the sleeve may protect the coupling from impacts against objects while the coupling is being moved during crane operations. The risk that the coupling may inadvertently snag an object can thus be reduced.

It will be appreciated that various changes and modifications can be made to the embodiment described herein without departing from the scope of the present invention.

The invention claimed is:

1. A crane comprising:

a hoist for performing a lifting operation, the hoist being movable in at least one lateral direction;

a controller for controlling lateral movement of the hoist;

a coupling attached to the hoist for connection to a load; and a height sensor for monitoring a height of the coupling;

wherein the controller is configured to inhibit lateral movement of the hoist by permitting only incremental lateral movements when the height sensor detects that the coupling is below a pre-defined operating height or that the coupling is outside one or more pre-defined operating height ranges.

2. A crane according to claim 1, further comprising a sensor for detecting a person in a defined safety region, wherein the controller is further configured to inhibit operation of the hoist when the imaging sensor detects a person in the safety region.

3. A crane according to claim 2, wherein the sensor for detecting a person in a defined safety region is a motion detection sensor.

4. A crane according to claim 1, the crane further comprising a load sensor for monitoring a load applied to the hoist, wherein the controller is further configured to inhibit a hoist lifting operation following detection by the load sensor of an initial load applied to the hoist.

5. A crane as claimed in claim 1, further comprising a load position sensor for determining the position of the or a load relative to the hoist.

6. A crane as claimed in claim 5, wherein the load position sensor comprises a laser and associated receiver.

7. A crane according to claim 1, wherein the hoist travels a predetermined distance in each incremental lateral movement.

8. A crane according to claim 1, wherein the controller is configured to cause the hoist to travel a predetermined distance in each incremental lateral movement, in response to each user input.

9. A crane according to claim 8, comprising a control unit having a joystick and/or a trigger, wherein the hoist travels a predetermined distance each time the joystick and/or the trigger is/are actuated.

10. A crane according to claim 9, wherein the joystick and/or trigger are returned to a neutral position and actuated again to cause the controller to initiate another incremental lateral movement of the hoist.

11. A method of operating a crane comprising a hoist and a coupling attached to the hoist;

wherein the method comprises monitoring a height of the coupling; and inhibiting lateral movement of the hoist to permit only incremental lateral movements when the height sensor detects that the coupling is below a pre-defined operating height or that the coupling is outside one or more pre-defined operating height ranges.

12. A method of operating a crane as claimed in claim 11, comprising controlling the hoist to travel a predetermined distance in each incremental lateral movement.

13. A crane control system for implementing the method as claimed in claim 11.

14. A method of operating a crane as claimed in claim 11, comprising controlling the hoist to travel a predetermined distance in each incremental lateral movement, in response to each user input.

15. A method of operating a crane as claimed in claim 14, comprising receiving an actuation signal from a crane control unit having a joystick and/or a trigger, and controlling the hoist to travel a predetermined distance each time the joystick and/or the trigger is/are actuated.

16. A method of operating a crane as claimed in claim 15, comprising initiating another incremental lateral movement of the hoist in dependence on receiving a signal indicative of the joystick and/or trigger being returned to a neutral position and being actuating again.

17. A method of operating a crane as claimed in claim 11, further comprising monitoring for the presence of a person in a defined safety region, and inhibiting operation of the hoist in dependence on detecting a person in the safety region.

18. A method of operation of a crane as claimed in claim 17, comprising monitoring for movement of a person in a defined safety region and inhibiting operation of the hoist in dependence on detecting movement of a person in the safety region.

* * * * *